US006311879B1

(12) United States Patent
Rigler et al.

(10) Patent No.: US 6,311,879 B1
(45) Date of Patent: Nov. 6, 2001

(54) CAP STORAGE AND BILL SHAPE MAINTENANCE DEVICE

(76) Inventors: Jerry H. Rigler; Brenda J. Rigler, both of 14441 Hayden Lake Rd., Hayden Lake, ID (US) 83835

( * ) Notice: Subject to any disclaimer, the term of this patent is extended or adjusted under 35 U.S.C. 154(b) by 0 days.

(21) Appl. No.: 09/693,404

(22) Filed: Oct. 20, 2000

Related U.S. Application Data

(60) Provisional application No. 60/163,468, filed on Oct. 25, 1999.

(51) Int. Cl.[7] ..... A41M 43/00; D06C 15/00

(52) U.S. Cl. ..... 223/84; 223/24; 211/30; 211/32; 211/33

(58) Field of Search ..... 223/24, 25, 85, 223/84; 211/30, 32, 33

(56) References Cited

U.S. PATENT DOCUMENTS

| | | | | |
|---|---|---|---|---|
| D. 393,970 | | 5/1998 | Lee | D6/514 |
| 3,208,597 | | 9/1965 | Hansen | 211/32 |
| 5,038,941 | * | 8/1991 | Bastiaansen | 211/32 |
| 5,137,157 | * | 8/1992 | Lawson | 211/32 |
| 5,244,102 | | 9/1993 | Koenig | 211/32 |
| 5,480,073 | | 1/1996 | LaManna | 223/1 |
| 5,685,465 | | 11/1997 | Berardis | 223/84 |
| 5,727,694 | | 3/1998 | Larson | 211/33 |
| 5,758,779 | | 6/1998 | Atkins | 211/32 |

* cited by examiner

*Primary Examiner*—Bibhu Mohanty
(74) *Attorney, Agent, or Firm*—David S. Thompson

(57) ABSTRACT

A cap storage and bill shape maintenance device (10) is adapted to receive the bills of a plurality of baseball or similar type caps, and to maintain the curvature of the bills of those caps. A main body (20) is formed of substantially mirror image front and back halves (30), (50) connected by a plurality of peg and socket or similar fastening structures. A plurality of generally horseshoe-shaped bill slots is defined in the main body. Two feet (70), (80) are attachable to the lower edge to support the main body in a vertical orientation. A hanger (90) attaches to a upper edge of the main body, and allows the device to be supported by the upper edge of a door, a rod in a closet, or other supporting structure. In use, by curving the bill of a cap, such as a baseball cap, the bill may be inserted into the bill slot. Time spent by the bill of the cap in the bill slot tends to overcome the resilience of the bill, allowing it to retain the rounded shape for hours. After the wearer takes off the cap, the bill of the cap is typically returned to the bill slot, for maintenance of the bill's curvature.

8 Claims, 4 Drawing Sheets

CAP STORAGE AND BILL SHAPE MAINTENANCE DEVICE

CROSS-REFERENCES

The present application is a continuation in part of a provisional application, filed Oct. 25, 1999 by the same inventors, having Ser. No. 60/163,468.

BACKGROUND

It is well known that baseball-type caps are very popular, and are worn by a wide cross-section of society, including children, men of all ages and many women. Such caps have a bill that is generally intended to face forward, but is frequently turned to the back by individuals attempting to achieve a different look. The bill is often constructed of fabric covered cardboard or similar material.

While it may seem to many observers that there are almost as many words and logos on caps as there are caps, people are always looking for a way to customize their cap from its original retail condition. One trend that is currently very popular is to bend the bill so that it is rounded, with the edges pointed generally downward.

While most such bending is done by hand, a device exists to maintain the curvature of the bill of a hat. U.S. Pat. No. 5,533,652, issued in 1994 to Levin, discloses a device that may be attached to the bill of a single cap. In use, the device forces the bill to assume a rounded shape. When the device is removed, the cap tends to maintain the rounded shape for a period of time.

Unfortunately, while such a device may have some utility with a single cap, it is not intended to maintain the shape of a plurality of caps simultaneously. Similarly, it is not intended to store caps in an organized manner for future use. As a result, a significant segment of the cap wearing market is still bending the bills of their caps manually.

For the foregoing reasons, there is a need for a cap storage and bill shape maintenance device that can store a plurality of caps for future use,

SUMMARY

The present invention is directed to an apparatus that satisfies the above needs. A novel cap storage and bill shape maintenance device is disclosed that stores a plurality of caps for future use, while maintaining the shape of the bill of each cap.

The cap storage and bill shape maintenance device of the present invention provides some or all of the following structures.

(A) A main body 20 defines a plurality of bill slots. In operation, the bill of one cap may be manually curved and inserted into each bill slot. While alternative embodiments are possible, in a preferred embodiment of the main body includes interlocking front and back halves 30, 50 that are substantially mirror images. Fastening means, carried by each half, engage the other half to result in a main body having attractively finished front and rear surfaces. The fastening means may include fastening pegs and sockets, interlocking rim and groove "snap-together" fasteners, or other known means.

(B) Similar left and right feet 70, 80 are carried within left and right foot alignment recesses defined adjacent to a lower edge of the main body. Each foot provides an elongated base oriented perpendicularly to the lower edge of the main body. A sidewall extending vertically from the base defines a slot within which the lower edge of the main body is carried.

(C) A hanger having an elongated body terminating in upper and lower hook ends supports the main body from a door or other object. In a preferred embodiment, the upper hook is configured to slide over the top of a door, while the lower hook is sized to slide into a hole defined in the perimeter of the main body.

It is therefore a primary advantage of the present invention to provide a novel cap storage and bill shape maintenance device that both stores a plurality of caps, and which also maintains the curvature of the bill of each cap.

Another advantage of the present invention is to provide a novel cap storage and bill shape maintenance device that is inexpensive and attractive, and which may be conveniently supported by either feet or a hanger, and which will appeal to a large segment of the cap-wearing market interested in maintaining the curvature of the bill of their caps.

A still further advantage of the present invention is to provide a novel cap storage and bill shape maintenance device that is efficiently constructed in a manner requiring no moving parts, elastic or springs, and which allows rapid insertion and removal of a cap in a convenient manner that encourages use, while leaving the other caps undisturbed.

Other objectives, advantages and novel features of the invention will become apparent to those skilled in the art upon examination of the specification and the accompanying drawings.

DRAWINGS

These and other features, aspects, and advantages of the present invention will become better understood with regard to the following description, appended claims, and accompanying drawings where:

DESCRIPTION

Figure 9:
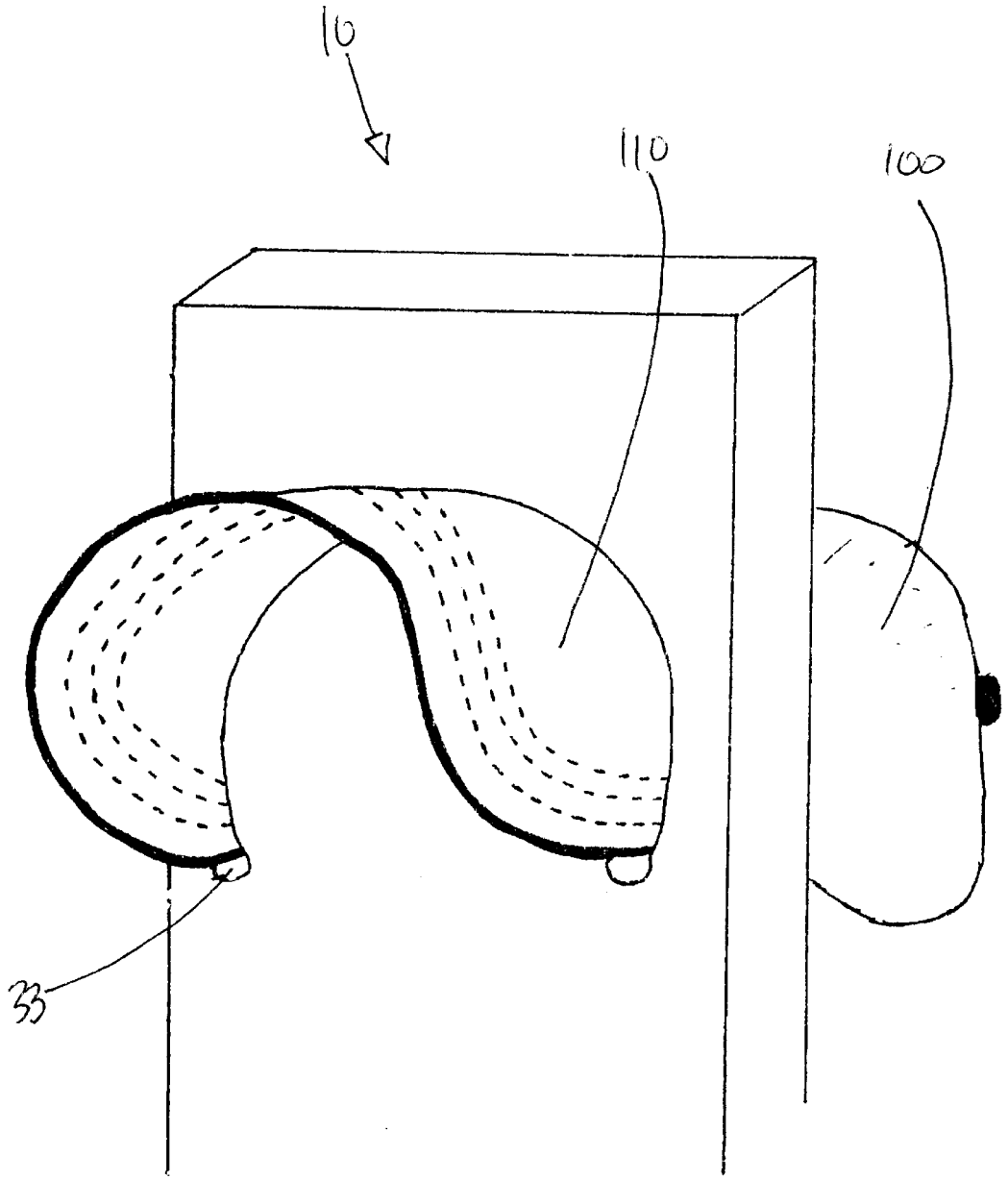
FIG. 9 is an isometric view of the bill of a cap inserted into one of the bill slots defined in the main body of the cap storage and bill shape maintenance device.

Referring in generally to FIGS. 1 through 8, a cap storage and bill shape maintenance device 10 constructed in accordance with the principles of the invention is seen. As seen particularly in the exploded view of FIG. 1, the main body 20 is formed of substantially mirror image front and back halves 30, 50 connected by a plurality of peg and socket or similar fastening structures. A plurality of generally horseshoe-shaped bill slots is defined in the main body. Two feet 70, 80 are attachable to the lower edge to support the main body in a vertical orientation. A hanger 90 attaches to a upper edge of the main body, and allows the device to be supported by the upper edge of a door, a rod in a closet, or other supporting structure. In use, by curving the bill 110 of a cap 100, such as a baseball cap, the bill may be inserted into the slot, as seen in FIG. 9. Time spent by the bill of the cap in the bill slot tends to overcome the resilience of the bill, allowing it to retain the rounded shape for hours. After the wearer takes off the cap, the bill of the cap is typically returned to the bill slot, for storage of the cap and maintenance of the curvature of the bill.

A main body 20 defines a plurality of bill slots. In operation, the bill of one cap may be manually curved and inserted into each bill slot. Because each bill slot is curved, the bill of the cap assumes approximately the same curvature. Because the bill of most caps has some resilience, maintenance of the bill's shape is required. In most cases, the bill is simply left in the bill slot when the cap is not being wom.

A preferred embodiment the main body includes interlocking front and back halves 30, 50 that are substantially mirror images. In particular, the front and back halves are mirror images, except for the fasteners carried by each half to engage the other half, and a commercial logo, which is typically defined only on the front half.

As seen in the preferred embodiment of FIGS. 1 through 4, each planar body 32, 52 is an elongated rectangle, having a 19.25 inch height and a 5.375 inch width. Each planar body has rounded upper comers having a 2" radius and lower comers having a 0.25 inch radius bevel.

Figures 2, 3, 4:
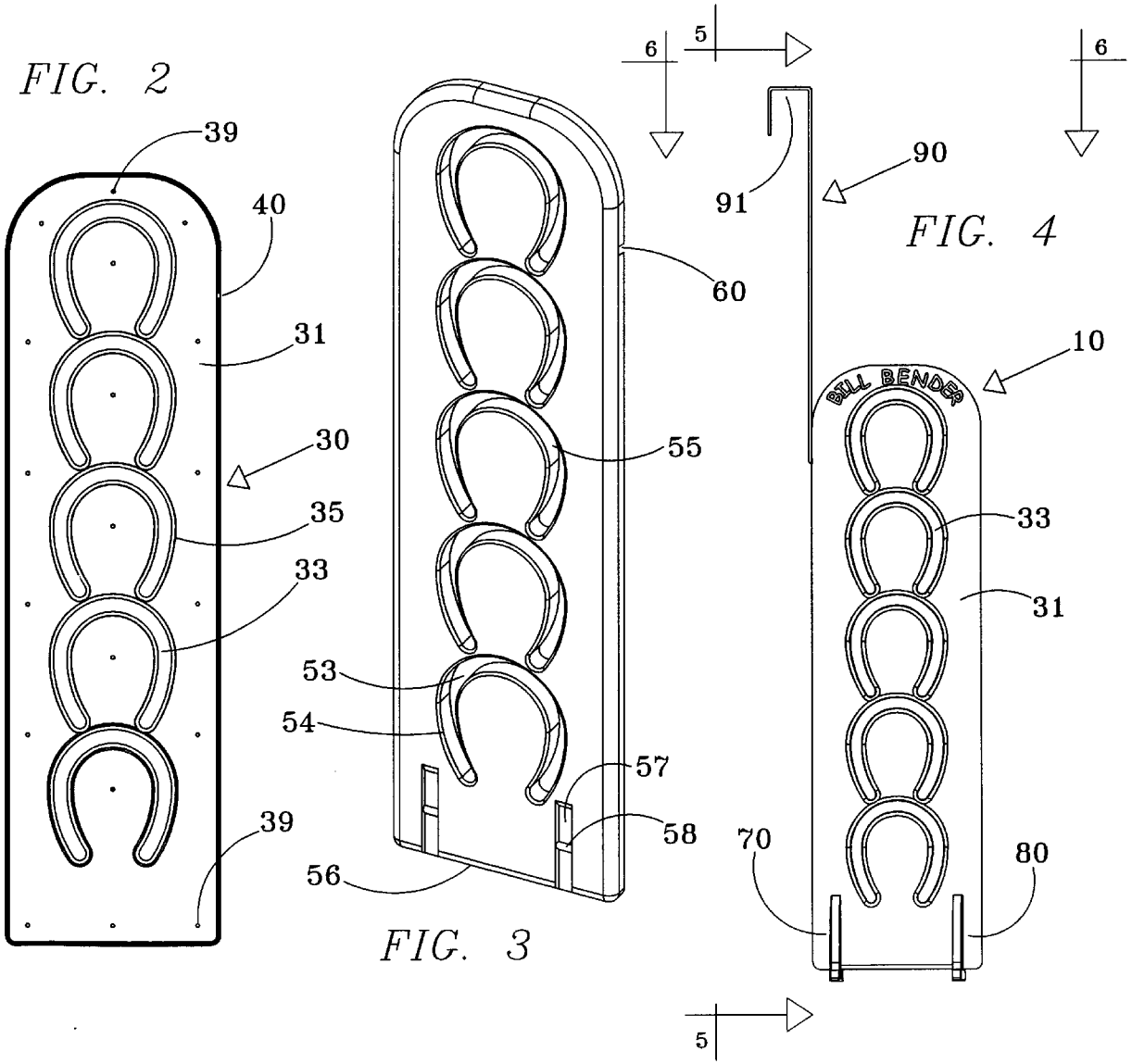
FIG. 2 is an orthographic view of the inside surface of the front half of the main body.
FIG. 3 is an isometric view of the outside surface of the back half.
FIG. 4 is a orthographic view of the assembled cap storage and bill shape maintenance device of FIG. 1.
Figure 5:
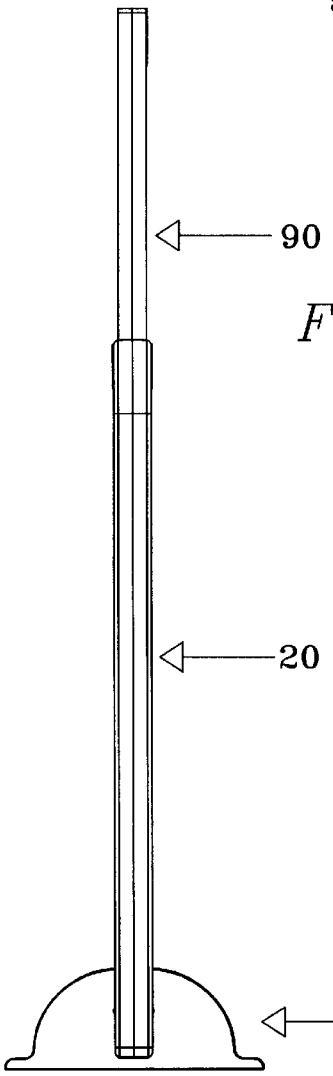
FIG. 5 is a side orthographic view of the cap storage and bill shape maintenance device, taken along the 5—5 lines of FIG. 4.
Figure 6:
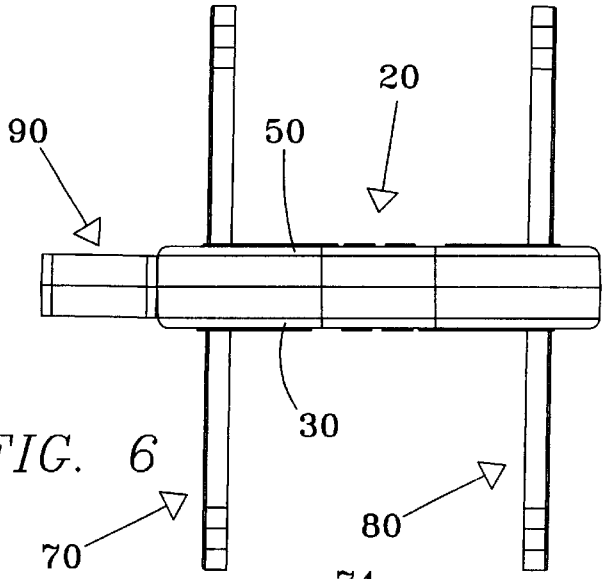
FIG. 6 is a top orthographic view of the cap storage and bill shape maintenance device, taken along the 6—6 lines of FIG. 4.
Figure 7:
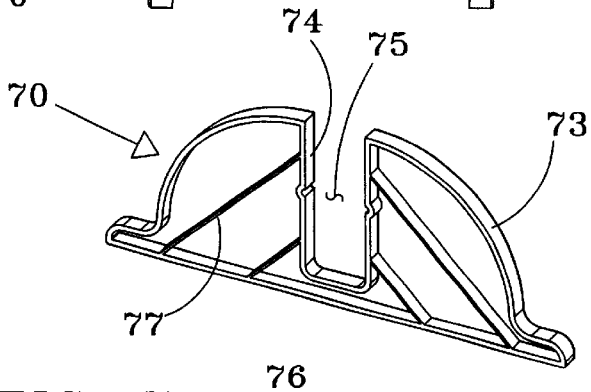
FIG. 7 is an orthographic view of a foot, showing the reinforcements present on the inside surface.
Figure 8:
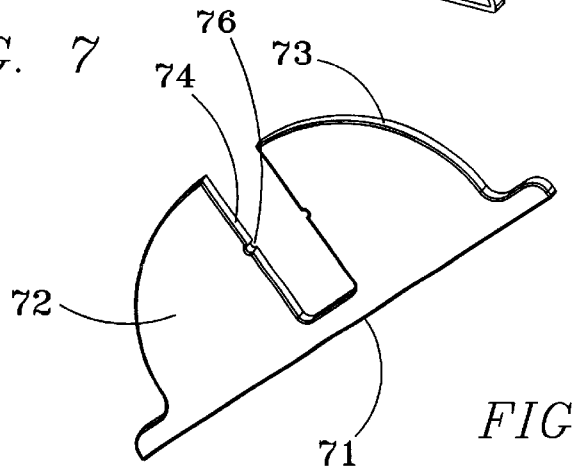
FIG. 8 is an orthographic view of the foot of FIG. 7, showing the reverse side.

In each body half, a perimeter rim 31, 51 is perpendicular to the planar body. The perimeter rim is approximately 0.5 inches wide and has a 0.25 inch radius. The perimeter rims of the front and back halves 30, 50 mate along a flush line, as seen in FIGS. 3, 5 and 6.

A plurality of bill slots 33, 53 are defined in each half. In the preferred embodiment, an array of five bill slots is vertically oriented. However, similar distributions of the slots could be used to achieve an equivalent result. Each bill slot has a beveled edge 34, 54 adjacent to a perpendicular sidewall 35, 55. Each bill slot is generally horseshoe-shaped, with an upper curvature having a radius of 2.0 inches, and a side curvature having a radius of 2.725 inches. The width of the horseshoe-shaped slot is typically approximately 0.375 inches.

The feet 70, 80 are attached to a lower edge 36, 56 of each planar body. Left and right foot alignment recesses 37, 57 are defined on the planar body of the front and rear halves, adjacent to the lower edge. The alignment recesses prevent the feet from sliding along the lower edge of the halves comprising the main body. A projection 38, 58 with the recess snaps into the notch 76 of each foot 70, 80, and tends to maintain the position of the foot until manual force causes the foot to flex sufficiently to pop off the main body.

Figure 1:
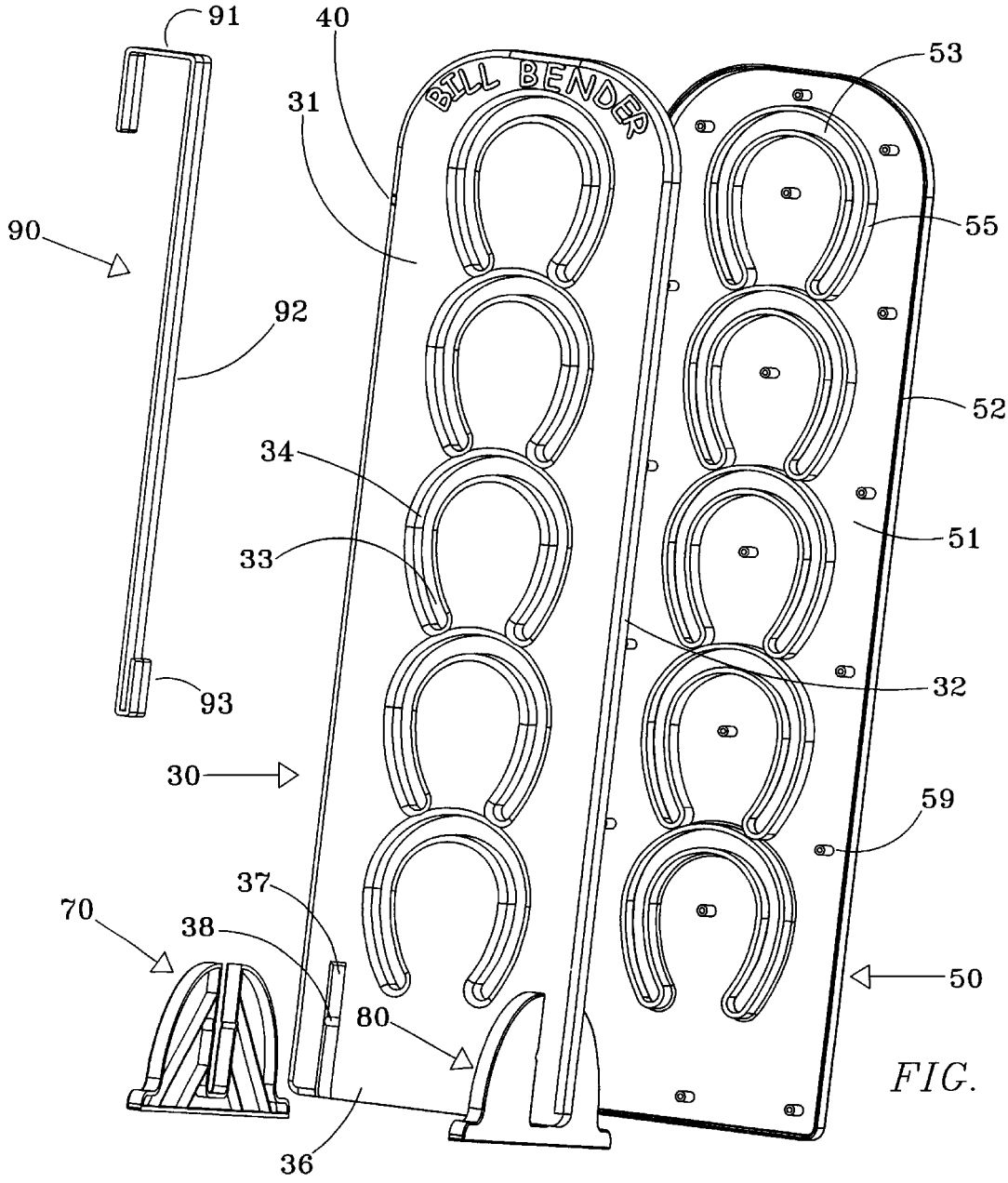
FIG. 1 is an exploded perspective view of a preferred version of the cap storage and bill shape maintenance device of the invention, showing the main body separated to reveal an outside surface of the front half and an inside surface of the back half; the left and right feet; and the hanger.

Fastening means, carried by each half, engage the other half to result in a main body having attractively finished front and rear surfaces. The fastening means may include fastening pegs and sockets; interlocking rim and groove snap-together fasteners, or other known means. As seen in FIGS. 1 and 2, in a preferred version of the invention, fastener pegs 39 on the front half 30 are sized for frictional insertion into fastener sockets 59 carried on the back half 50. As seen by a comparison of FIGS. 1 and 2, each fastener peg is associated with a fastener socket that is aligned in a collinear manner. As is apparent to those associated with the plastics industry, a number of similar alternative fastening structures could be substituted.

Openings 40, 60 defined within adjacent portions of the perimeter rim 32, 52 of front and back halves combine to define an opening in the main body 20 through which the lower hook 93 of the hanger 90 may be inserted. The openings are adjacent, thereby forming an approximately 0.75 inch opening that is incrementally wider than the hanger 90.

The use of injected plastic manufacturing techniques to construct the interlocking halves is preferred. Altematively, the main body may be made of extruded material, a solid one-piece monolith, or other configuration, as desired.

Left and right feet 70, 80 are carried within left and right foot alignment recesses defined adjacent to a lower edge of the main body. Each foot provides an elongated base 71 oriented perpendicularly to the lower edge of the halves forming the main body. A sidewall 72 extending vertically from the base has a curved perimeter 73. A slot sidewall 74 defines a slot 75 sized to receive the lower edge of the main body. A notch 76 in the slot sidewall 74 corresponds to the projection 38, 58 present within the foot alignment recess on each half 30, 50. Reinforcements 77 provide structural strength and rigidity to the feet.

As seen in FIGS. 1, 4, 5 and 6, a hanger 90 has an elongated body 92 terminating in upper and lower hooks. In use, the hanger supports the main body 20 from a door or other object.

In a preferred embodiment, the upper hook 91 is configured to slide over the top of a door, while the lower hook 93 is sized to slide the hole defined in the side of the main body by openings 40, 60 defined in the perimeter rim of the front and back halves.

To assemble the cap storage and bill shape maintenance device 10, the front and rear halves 30, 50 are connected to form the main body 20. In the preferred embodiment, this requires manually inserting the fastener pegs 39 into the fastener sockets 59 by aligning the front and rear halves and gently pushing them together. Where an alternative fastening structure is used, a correspondingly different assembly step will be employed.

Where the main body is to be supported by feet, the feet as snapped onto the lower edge over the foot alignment recesses. The projections 38, 58 engage the notches 76 for a frictional fit.

Where the main body is to be hung from a supporting structure, such as a door, the lower hook 93 of the hanger is inserted into the hole defined on the perimeter rim of the main body.

When a ball cap is stored within the cap storage and bill shape maintenance device 10, the bill is manually bent, and inserted into one of the bill slots. A total of five caps may be stored in this manner in the preferred version of the invention. Time spent in the bill slot causes the bill to conform to the curvature of the bill slot. Because bills are not particularly resilient, when the cap is worn, the bill continues to retain the shape of the bill slot. Storage of the cap in the device 10 when the cap is not in use overcomes any resilience the bill has, and results in a preferable bill shape at all times.

The previously described versions of the present invention have many advantages, including a primary advantage of providing a novel cap storage and bill shape maintenance device that both stores a plurality of caps, and which also maintains the curvature of the bill of each cap.

Another advantage of the present invention is to provide a novel cap storage and bill shape maintenance device that is inexpensive and attractive, and which may be conveniently supported by either feet or a hanger, and which will appeal to a large segment of the cap-wearing market interested in maintaining the curvature of the bill of their caps.

A still further advantage of the present invention is to provide a novel cap storage and bill shape maintenance device that is efficiently constructed in a manner requiring no moving parts, elastic or springs, and which allows rapid insertion and removal of a cap in a convenient manner that encourages use, while leaving the other caps undisturbed.

Although the present invention has been described in considerable detail and with reference to certain preferred versions, other versions are possible. For example, while the main body of the preferred embodiment is made of front and rear halves, it is clear that the main body could be made of a single piece of material to reduce costs, while not overly degrading the appearance and effectiveness of the overall device. Similarly, while the preferred embodiment illustrated defines five locations for caps, it is clear that a greater or lesser number could be substituted. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A cap storage and bill shape maintenance device, comprising:

(A) a main body defining a plurality of bill slots, the main body comprising:

(a) a front half, comprising a planar body defining a plurality of bill slots and defining left and right foot alignment recesses adjacent to a lower edge of the main body, each foot alignment recess having a projection;

(b) a back half, substantially a mirror image of the front half; and (c) at least one fastener, for attaching the front half to the back half.

2. The cap storage and bill shape maintenance device of claim 1, further comprising:

(A) left and right feet, carried by a lower edge of the main body.

3. The cap storage and bill shape maintenance device of claims 2, wherein the left and right feet each comprise:

(a) an elongated base oriented perpendicularly to the lower edge of the main body; and (b) a sidewall extending vertically from the base, the sidewall defining a slot within which the lower edge of the main body is carried.

4. The cap storage and bill shape maintenance device of claim 3, further comprising:

(A) a hanger having an elongated body having an upper end terminating in upper hook and a lower end terminating in a lower hook sized for insertion into an opening defined in the main body, whereby the hanger may support the main body during use.

5. The cap storage and bill shape maintenance device of claim 1, further comprising:

(A) left and right feet, carried by a lower edge of the main body.

6. The cap storage and bill shape maintenance device of claim 5, wherein the left and right feet each comprise:

(a) an elongated base oriented perpendicularly to the lower edge of the main body; and (b) a sidewall extending vertically from the base, the sidewall defining a slot within which the lower edge of the main body is carried.

7. The cap storage and bill shape maintenance device of claim 1, further comprising:

(A) a hanger having an elongated body having an upper end terminating in upper hook and a lower end terminating in a lower hook sized for insertion into an opening defined in the main body, whereby the hanger may support the main body during use.

8. A cap storage and bill shape maintenance device, comprising:

(A) a main body, comprising:

(a) a front half, comprising a planar body defining a plurality of bill slots and defining left and right foot alignment recesses adjacent to a lower edge of the main body, each foot alignment recess having a projection;

(b) a back half, substantially a mirror image of the front half; and (c) at least one fastener, for attaching the front half to the back half;

(B) left and right feet, carried within left and right foot alignment recesses, respectively, each foot comprising:

(a) an elongated base oriented perpendicularly to the lower edge of the main body; and (b) a sidewall extending vertically from the base, the sidewall defining a slot within which the lower edge of the main body is carried; and (C) a hanger having an elongated body having an upper end terminating in upper hook and a lower end terminating in a lower hook sized for insertion into an opening defined in the main body, whereby the hanger may support the main body during use.

* * * * *